US011027572B2

(12) United States Patent
Bradley

(10) Patent No.: US 11,027,572 B2
(45) Date of Patent: Jun. 8, 2021

(54) SYSTEMS AND APPARATUS FOR COVERING, PROTECTING, AND CONCEALING PERSONAL, PRIVATE, CONFIDENTIAL, AND NONPUBLIC INFORMATION

(71) Applicant: Rebecca Bradley, Dandridge, TN (US)

(72) Inventor: Rebecca Bradley, Dandridge, TN (US)

( * ) Notice: Subject to any disclaimer, the term of this patent is extended or adjusted under 35 U.S.C. 154(b) by 0 days.

(21) Appl. No.: 16/888,734

(22) Filed: May 31, 2020

(65) Prior Publication Data

US 2020/0376882 A1 Dec. 3, 2020

Related U.S. Application Data

(62) Division of application No. 16/668,749, filed on Oct. 30, 2019, now Pat. No. 10,946,689.

(60) Provisional application No. 62/757,722, filed on Nov. 8, 2018, provisional application No. 62/899,154, filed on Sep. 12, 2019.

(51) Int. Cl.

| | |
|---|---|
| ***B42F 13/26*** | (2006.01) |
| ***B42F 13/16*** | (2006.01) |
| ***B42F 13/40*** | (2006.01) |
| ***B42F 13/00*** | (2006.01) |
| ***B42F 3/04*** | (2006.01) |
| ***B42B 5/10*** | (2006.01) |
| ***B42D 1/00*** | (2006.01) |
| ***B42B 5/12*** | (2006.01) |

(52) U.S. Cl.

CPC ..... *B42F 13/26* (2013.01); *B42F 3/04* (2013.01); *B42F 13/004* (2013.01); *B42F 13/165* (2013.01); *B42F 13/40* (2013.01)

(58) Field of Classification Search

CPC .. B42F 13/26; B42F 3/04; B42F 13/40; B42F 13/004; B42F 13/165

USPC ..... 281/2, 5, 7, 9, 14, 15.1; 283/82, 98, 61, 283/62, 901

See application file for complete search history.

(56) References Cited

U.S. PATENT DOCUMENTS 5,820,383 A * 10/1998 Levins ..... A63F 9/34 434/238

* cited by examiner

*Primary Examiner* — Justin V Lewis

(57) ABSTRACT

Systems and apparatus for covering, protecting, and concealing personal, private, confidential, and nonpublic information. The systems and apparatus can include a releasable, removable, or unreleasable binding device, tamper-evident features, labeling features, and binding devices can be configured to connect and secure covering devices and which can substantially rotate 360 degrees, fold back upon itself, lie flat when open, and releasable covering devices to cover personal, private, nonpublic, or other information.

6 Claims, 5 Drawing Sheets

SYSTEMS AND APPARATUS FOR COVERING, PROTECTING, AND CONCEALING PERSONAL, PRIVATE, CONFIDENTIAL, AND NONPUBLIC INFORMATION

CROSS-REFERENCE TO RELATED APPLICATIONS

This application is a divisional of pending U.S. Non Provisional application Ser. No. 16/668,749, filed Nov. 30, 2019, U.S. Provisional Application Ser. No. 62/757,722, filed Nov. 8, 2018, the entirety which is incorporated herein by this reference and claims the benefit of priority from U.S. Provisional Application Ser. No. 62/899,154, filed Sep. 12, 2019, the entirety which is incorporated herein by this reference.

BACKGROUND

1. Technical Field

The present invention is generally related to systems and apparatus for covering, protecting, and concealing personal, private, confidential, and nonpublic information, secret, or other information.

2. Description of the Related Art

Notaries Public provide notarial and authentication services to the general public and in numerous industries such as banking, real estate closings, employment, and other industries requiring verification of identity and signature witnessing. Generally, a Notary Public (also referred to as a "Notary" or "public Notary") is a public officer constituted by law to serve the public in non-contentious matters usually concerned with estates, deeds, powers-of-attorney, and foreign and international business. A Notary Public's main functions are to serve the public as an impartial witness in performing a variety of official acts related to transactions and signing of important documents such as which grant powers of attorney, convey interest in real estate, and other documents. A Notary's duty is to screen a signer's identity, their signing without duress or intimidation, and their awareness of the transaction or contents of the document being signed. The Notary may administer oaths and affirmations, take affidavits, and statutory declarations, witness and authenticate the execution of certain classes of documents, such as, for example, take acknowledgments of deeds and other conveyances, protest notes and bills of exchange, provide notice of foreign drafts, prepare marine or ship's protests in cases of damage, provide exemplifications and notarial copies, and perform certain other official acts depending on the jurisdiction. Any such act is known as a notarization or a notarial act.

Typically, there are multiple methods of identification presented to a Notary Public and extensive titles of documents a Notary Public records. Recording such data and information can be time consuming as documents, acts, and services must be substantially written in a Notary journal. For example, some Notary journals have record entries containing a box that can be quickly checked for an Acknowledgement or Oath but do not contain a box to quickly check the type of identification method presented by a signer/affiant, such as driver's license, tribal card, or credible witness, or for quickly checking a box for a specific title of the type of document being notarized, such as a Power of Attorney, bill of sale, contract, last will and testament, etc., or have an acronym reference list which can assist a Notary Public to record such more quickly. Additionally, for the purposes of signature authentication, a Notary Public verifies a signature of a signer/affiant with a signature on the identification method presented to a Notary Public by a signer/affiant before a document can be officially notarized, recorded, and/or have legal effect. In many states and countries, a citizen utilizing the services of a Notary Public sign within a record of a Notary Public's journal (also referred to as book, logbook, book of notarial acts, journal of notarial acts, or record book). The Notary Public must be reasonably satisfied that the identification presented is authentic, valid, unexpired, and matches the signer/affiant. That determination may be made by multiple methods including comparing and/or matching a signer/affiant's signature made in a Notary Public's journal, with and/or against the identification presented by a signer/affiant; by visual inspection of physical data, photograph, and signatures shown on an identification method presented by a signer/affiant; by the physical appearance; by comparing and/or matching relevant information and/or signatures on other documents and records; by usage of credible witnesses; and other law-regulated or best practice guidelines and procedures.

Historically, a Notary journal consists of a bound book. The type of Notary journal may be governed by state laws but generally must be well-bound. The term well-bound, is not generally specific, however, when referring to a Notary journal, it is oftentimes assumed in reference to prevent fraud, tampering with the contents of a journal, and having journal and content integrity, generally meaning the condition of being unified, unimpaired, or of sound construction and the state of being whole and undivided. Often, notarial acts and events are recorded in a Notary journal in exact numerical and sequential order. The bound book includes line item information records for data entry that contain, for example, information regarding the type of document notarized, a signer/affiant, a place for a signer/affiant's signature. Data entered regarding a signer/affiant may include information, personal, private, NonPublic Personal Information (NPPI or NPI) such as their name, address, driver's license number, date of birth, fingerprint, etc. Information specific to a signer/affiant may also include the nature of a signed or notarized document which may reveal private, personal, confidential, nonpublic information. A Notary Public enters signer/affiant information into a Notary journal and upon examination and verification of the identification presented for authenticity and accuracy of identity, a Notary Public may then turn a Notary journal and present it to the signer/affiant for their signature and/or fingerprint (generally a thumbprint). Papers, books, journals, or ledgers used in a plurality of applications including business, industry, and government, may contain personal, private, NPPI or NPI, confidential, including intellectual property or secret information.

Typically, a bound book may contain any number of pages. Notary Journals, for example may contain about 60-150 pages with each page including up to eight to eighteen information records. A Notary journal is not configured to keep private information from the view of others or subsequent signers/affiants. When open, the bound book may reveal approximately seven to seventeen records containing private information. For example, a signer/affiant that places their signature or fingerprint for identification verification on line seven of a book is able to see information records for the previous six signers/affiants, and a signer/affiant on line 14 is able to view information records for the previous 13 signer/affiants.

Thus, NPPI and other signer/affiant information is exposed.

Notaries for example, are professionals and generally state commissioned officials who are guided by standards, principals, and/or laws that include protecting private, nonpublic, personal information. This includes concealing information and prior signer/affiant information already entered in a journal from the general public, current signer/affiants, clients, or others, and while a journal is in usage, being viewed or reviewed, during data entry, and when verifying the identification of a signer/affiant, and/or presenting a journal for a signature or fingerprint for authentication.

Thus, Notaries Public have used Notary journals with such binding systems and methods as library binding, edition binding, publisher binding, standard binding, Smyth-sewn binding, glued binding, and other similar bindings, which do not generally lay flat when open, and do not conceal information records or data.

Notaries Public have attempted to conceal NPPI in such bound journals using a sheet of paper or with a folder as in U.S. Pat. No. 7,946,552B1 which is a type of substantially opaque privacy folder sleeve which can be slid or placed around a page to cover any portion of a page to prevent others and/or subsequent signer/affiant's from viewing data records, a previous signer/affiant's NPPI, and/or committing identity theft. A disadvantage of this type of covering device is that such device is oftentimes moved out of the way by a signer/affiant, inadvertently, and/or purposefully when signing the Notary Journal. Also, a Notary Journal will generally not lay flat when open due to a natural curvature of the bookbinding spine which can further complicate the use of the folder sleeve. Another disadvantage of such covering device is that the device may not stay where placed, if bumped, when moving the Notary Journal about, or when presenting the book to a signer/affiant to receive their signature, fingerprint, or for other reasons. A sheet of paper or folder tends to shift when a Notary turns and presents a Notary Journal to a signer/affiant for their signature and/or fingerprint. A sheet of paper or folder tends to be moved or pushed by a signer/affiant when a Notary turns and presents a Notary Journal to a signer/affiant for their signature and/or fingerprint. Additionally, many current Notary Journals can contain NPPI record sections for a single record on two facing pages of a journal which may require concealment of NPPI on two pages, simultaneously. In such Notary journals, the possibility of NPPI exposure can double and be twice as challenging to conceal. The sheet of paper or folder sleeve concealment approach may leave NPPI of prior signer/affiants exposed.

Notaries are not the only people, profession, industry that seeks to conceal or protect private, personal, and/or nonpublic information. For example, hospitals and medical offices seek to comply with Health Insurance Portability and Accountability Act of 1996 (HIPPA) requirements, and scientists, accountants, corporations, businesses, government agencies, private citizens, and others seek to reduce visibility of documents, records, data, private and/or NPPI such as medical information, records, log books, accounting ledgers, business journals, books, scientific records, top-secret documents, records, and data, and similar data or information from exposure or undesired or unauthorized exposure.

Thus, solutions are needed to solve these problems.

SUMMARY OF THE INVENTION

The aforementioned problems and other problems are reduced by systems and apparatus for covering, protecting, and concealing personal, private, confidential, nonpublic, secret information, intellectual property, or other information, in accordance with the present invention.

In one embodiment of the present invention, the system comprises a covering device for releasably covering, protecting, and concealing personal, private, confidential, and nonpublic information including a plurality of magnetic repositionable strips and a magnetic repositionable sheet and wherein the magnetic repositionable strips are sized to adhere to and cover personal, private, and nonpublic information and the magnetic repositionable sheet is at least sized to adhere to the plurality of magnetic repositionable strips.

In one embodiment of the present invention, the system comprises a covering device for releasably covering, protecting, and concealing personal, private, confidential, and nonpublic information, or other information including a plurality of magnetic repositionable strips and a magnetic repositionable sheet, and a connecting component configured to connect the magnetic repositionable strips to the magnetic repositionable sheet, and wherein the magnetic repositionable strips are sized to adhere to and cover personal, private, and nonpublic information and the magnetic repositionable sheet is at least sized to adhere to the plurality of magnetic repositionable strips.

In another alternative embodiment of the present invention, the system comprises a covering device for releasably covering, protecting, and concealing personal, private, confidential, and nonpublic information, intellectual property, or other information including a plurality of repositionable strips magnetized on a first side and a second side forming double magnetized repositionable strips and a sheet magnetized on a first side and a second side of the sheet forming a double magnetized sheet with both sides of the double magnetized sheet are configured to receive and releasably adhere to both sides of the double magnetized repositionable strips, wherein the double magnetized repositionable strips are sized to adhere to and cover the personal, private, and nonpublic information.

In another alternative embodiment of the present invention, the system comprises a covering device for releasably covering, protecting, and concealing personal, private, confidential, and nonpublic information, intellectual property, or other information including a plurality of repositionable strips magnetized on a first side and a second side forming double magnetized repositionable strips and a sheet magnetized on a first side and a second side of the sheet forming a double magnetized sheet with both sides of the double magnetized sheet are configured to receive and releasably adhere to both sides of the double magnetized repositionable strips, and a connecting component configured to connect the double magnetized sheet to the double magnetized repositionable strips, wherein the double magnetized repositionable strips are sized to adhere to and cover the personal, private, and nonpublic information.

In another embodiment of the present invention, the system comprises a covering device for providing security for, reducing exposure, covering, protecting, and concealing personal, private, confidential, and nonpublic information, intellectual property, or other information comprising a folder sleeve having a first face and a second face, the first face having a substantially opaque exterior side and an interior side having at least one magnetic component or border and the second face having an interior side having at least one magnetic interior component or border, and wherein the first face and the second face forming the folder sleeve such that the folder sleeve can secure the contents of the folder or can slip over two sides and a corner and releasably magnetically join the magnetic components or border edges to secure the folder sleeve where positioned.

In another embodiment of the present invention, the system comprises a covering device for releasably providing security for, covering, protecting, and concealing personal, private, confidential, and nonpublic information, intellectual property, or other information including at least one or a plurality of a substantially opaque repositionable adhesive strips having a first edge and at least one or a plurality of non-adhesive handling tabs configured to extend from the first edge of the substantially opaque repositionable adhesive strip, wherein the substantially opaque repositionable adhesive strip is configured to cover personal, private, nonpublic information and configured for repositioning.

In one embodiment of the present invention, the system comprises a covering device for releasably covering, protecting, and concealing personal, private, confidential, and nonpublic information, intellectual property, or other information including a plurality of magnetic repositionable strips and a magnetic repositionable sheet and wherein the magnetic repositionable strips are sized to adhere to and cover personal, private, and nonpublic information and the magnetic repositionable sheet is at least sized to adhere to the plurality of magnetic repositionable strips.

In one embodiment of the present invention, the system comprises a covering device for releasably covering, protecting, and concealing personal, private, confidential, and nonpublic information, intellectual property, or other information including a plurality of magnetic repositionable strips and a magnetic repositionable sheet, and a connecting component configured to connect the magnetic repositionable strips to the magnetic repositionable sheet, and wherein the magnetic repositionable strips are sized to adhere to and cover personal, private, and nonpublic information and the magnetic repositionable sheet is at least sized to adhere to the plurality of magnetic repositionable strips.

In another alternative embodiment of the present invention, the system comprises a covering device for releasably covering, protecting, and concealing personal, private, confidential, and nonpublic information, intellectual property, or other information including a plurality of repositionable strips magnetized on a first side and a second side forming double magnetized repositionable strips and a sheet magnetized on a first side and a second side of the sheet forming a double magnetized sheet with both sides of the double magnetized sheet are configured to receive and releasably adhere to both sides of the double magnetized repositionable strips, wherein the double magnetized repositionable strips are sized to adhere to and cover the personal, private, and nonpublic information.

In another alternative embodiment of the present invention, the system comprises a covering device for releasably covering, protecting, and concealing personal, private, confidential, and nonpublic information, intellectual property, or other information including a plurality of repositionable strips magnetized on a first side and a second side forming double magnetized repositionable strips and a sheet magnetized on a first side and a second side of the sheet forming a double magnetized sheet with both sides of the double magnetized sheet are configured to receive and releasably adhere to both sides of the double magnetized repositionable strips, and a connecting component configured to connect the double magnetized sheet to the double magnetized repositionable strips, wherein the double magnetized repositionable strips are sized to adhere to and cover the personal, private, and nonpublic information.

In another embodiment of the present invention, the system comprises a covering device for reducing exposure, covering, protecting, and concealing personal, private, confidential, and nonpublic information, intellectual property, or other information comprising a folder sleeve having a first face and a second face, the first face having a substantially opaque exterior side and an interior side having at least one magnetic component or border and the second face having an interior side having at least one magnetic interior component or border, and wherein the first face and the second face forming the folder sleeve such that the folder sleeve can secure the contents of the folder or can slip over two sides and a corner and releasably magnetically join the magnetic components or border edges to secure the folder sleeve where positioned.

In another embodiment of the present invention, the system comprises a covering device for reducing exposure, covering, providing security, and concealing personal, private, non-public, confidential, secret, intellectual property, or other information comprising a folder sleeve having a first face and a second face, the first face having a substantially opaque exterior side and an interior side having at least one magnetic component or border and the second face having an interior side having at least one magnetic interior component or border, and wherein the first face and the second face forming the folder sleeve such that the folder sleeve can secure the contents of the folder or can slip over two sides and a corner and releasably magnetically join the magnetic components or border edges to secure the folder sleeve where positioned.

With another embodiment of the invention is a system for providing security for, evidence of tampering, and covering, protecting, and concealing personal, private, confidential, and nonpublic information, intellectual property, or other information comprising a binding device configured to connect, secure, and bind the covering devices such that the connected covering device can substantially rotate 360 degrees and can fold back upon itself and lie flat when open, a covering device configured to cover the personal, private and nonpublic information, can include a tamper-evident device such as an indicative seal, barrier seal, security seal, security sticker, plastic seal, metal seal, adjustable length seal, banking seal, fixed seal, bolt seal, screw seal, security ring, locking seal, padlock seal, Radio Frequency Identification (RFID) tag, electronic ID-dentification (eID) tag, microchip tag, Unique Identifier (UID) tag, Personal Identifier (PID) tag, transponder, and digital identifier (collectively referred to as a security seal) inserted in at least one combining hole, or attached to at least one combining loop.

With another embodiment of the invention is a system for providing security for, evidence of tampering, and covering, protecting, and concealing personal, private, confidential, and nonpublic information, intellectual property, or other information comprising a binding device configured to connect, secure, and bind the covering devices such that the connected covering device can substantially rotate 360 degrees and can fold back upon itself and lie flat when open, a covering device configured to cover the personal, private and nonpublic information, can include a tamper-evident device such as an indicative seal, barrier seal, security seal, security sticker, plastic seal, metal seal, adjustable length seal, banking seal, fixed seal, bolt seal, screw seal, security ring, locking seal, padlock seal, Radio Frequency Identification (RFID) tag, electronic IDdentification (eID) tag, microchip tag, Unique Identifier (UID) tag, Personal Identifier (PID) tag, transponder, and digital identifier (collectively referred to as a security seal) inserted or attached to the connecting binding spine.

With another embodiment of the invention is a system for providing security for, evidence of tampering, and covering, protecting, and concealing personal, private, confidential, and nonpublic information, intellectual property, or other information comprising a binding device configured to connect, secure, and bind the covering devices such that the connected covering device can substantially rotate 360 degrees and can fold back upon itself and lie flat when open, a covering device configured to cover the personal, private and nonpublic information, can include a tamper-evident device such as an indicative seal, barrier seal, security seal, security sticker, plastic seal, metal seal, adjustable length seal, banking seal, fixed seal, bolt seal, screw seal, security ring, locking seal, padlock seal, Radio Frequency Identification (RFID) tag, electronic ID-dentification (eID) tag, microchip tag, Unique Identifier (UID) tag, Personal Identifier (PID) tag, transponder, and digital identifier (collectively referred to as a security seal) inserted or attached to any part of the covering device.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The present invention provides systems and methods for covering, protecting, and concealing personal, private, confidential, and nonpublic information, intellectual property, or other information in view, while viewing, using, data entry, and/or recording information, such as, for example personal information.

Figure 1:
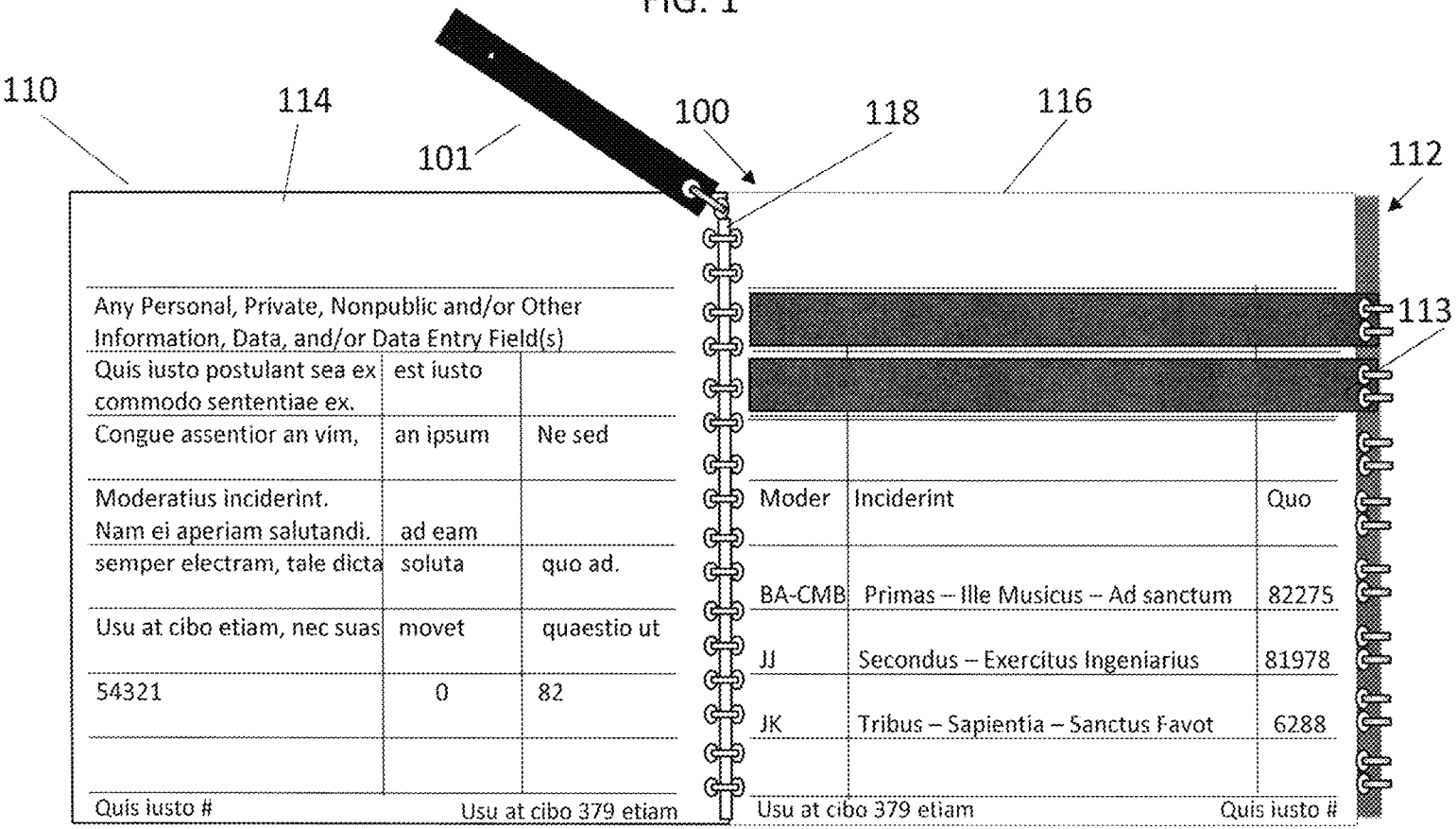
FIG. 1 shows an exemplary view of a system for covering, protecting, and concealing personal, private, confidential, and nonpublic information, intellectual property, or other information.

FIG. 1 is an exemplary view of a system 100 for covering, protecting, and concealing personal, private, confidential, and nonpublic information, intellectual property, or other information in view, viewing, recording, or using such information, in which an embodiment of the present invention may be implemented. The system 100 comprises a bound plurality of papers which can include their covers, 110 (also referred to as a book or journal) that includes multiple pages (only two pages shown), a covering device 112 and a binding device 118. The book 110 further comprises a first side 114 (or page) and a second side 116 (or page). The first side 114 and the second side 116 of the book 110 are bound together with a binding device 118 or binding adhesive such as, for example, glue that binds the multiple pages of the book 110.

In an embodiment, the covering device 112 further comprises magnetic repositionable strips 113 configured to releasably cover information on the first side 114 and/or second side 116 of the book 110.

Figure 1A:
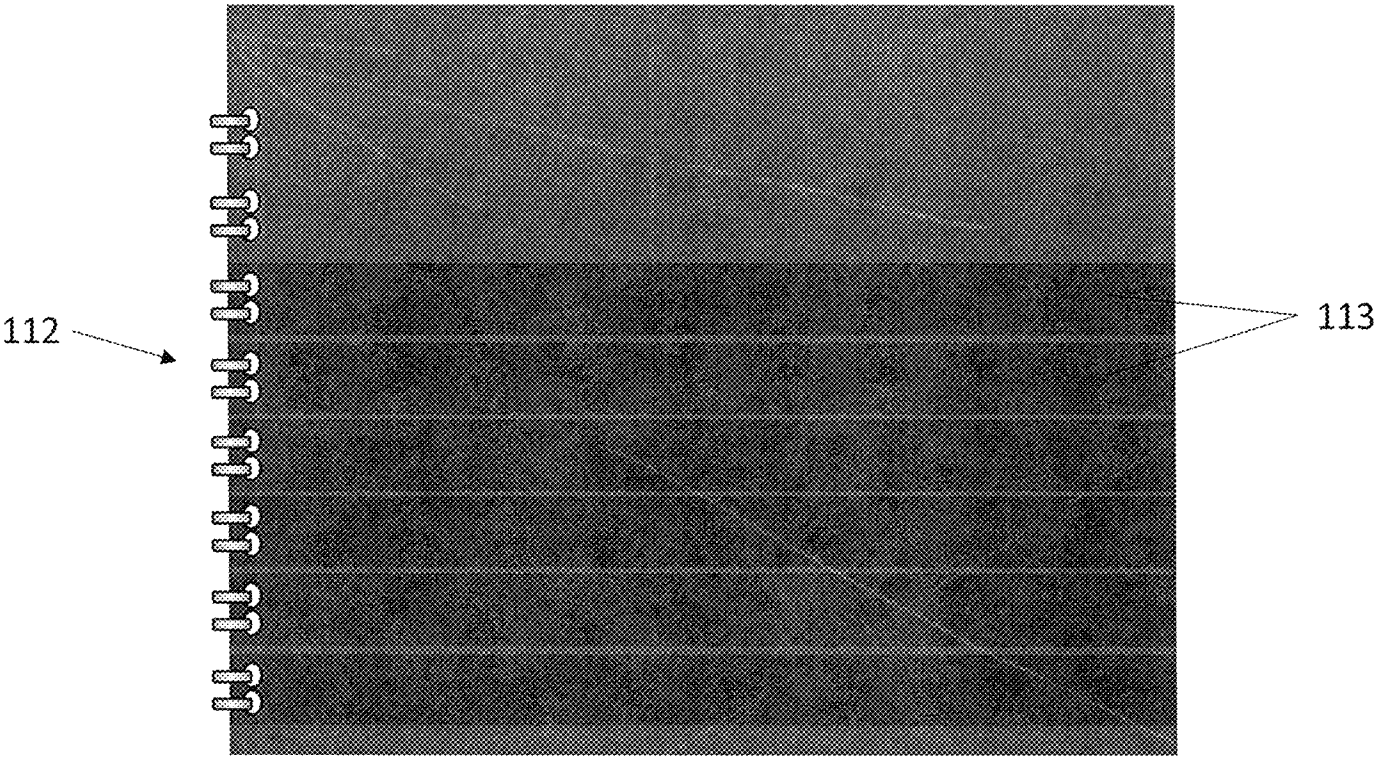
FIG. 1A shows a detailed view of the covering device of the system shown in FIG. 1.

FIG. 1A shows a detailed view of the covering device 112 shown in FIG. 1 with magnetic repositionable strips 113.

In FIG. 1 for illustrative purposes, the covering device 112 is only shown on the second side 116 of the book 110. The magnetic repositionable strips 113 are configured such that private, and/or completed information is not visible to unauthorized viewers and/or a subsequent viewers or signer/affiant and/or while in view, or viewing, usage, data entry, and/or recording information, thereby reducing visibility and exposure of private, personal, or nonpublic information.

Figure 2A:
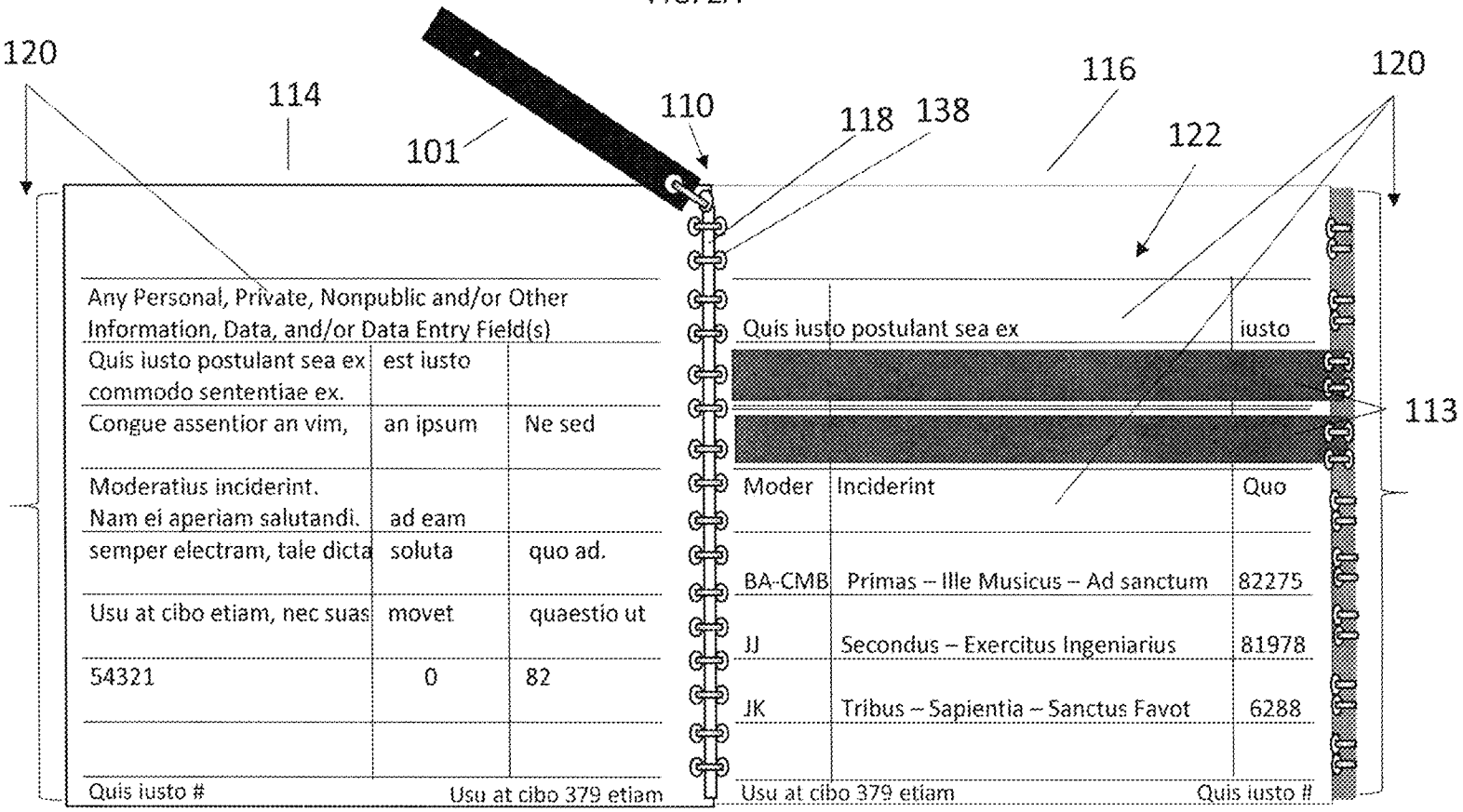
FIG. 2A shows an exemplary view of a journal with systems for covering, protecting, and concealing personal, private, confidential, and nonpublic information, intellectual property, or other information, according to one embodiment of the present invention.

FIG. 2A shows an exemplary book 110 for use with a system for covering, protecting, and concealing personal, private, confidential, and nonpublic information, intellectual property, or other information while in view, recording, viewing, or using of personal, private, and nonpublic information. In an embodiment, the book 110 includes private information and/or information records 120 on the first side 114 of the book 110 and private, nonpublic, identity, signature authentication information, and/or records 122 on the second side 116 of the book 110. The information and/or records 120 can include private, personal, confidential, nonpublic, intellectual property, or secret information such as, for example, government information, medical information, scientific log information, top-secret information, and/or private information. In an embodiment, the information records 120 are configured with headings that describe each section of the information and/or records 120 and individual information sections and/or lines. In an embodiment, for example, the information and/or records 120 may include a record number, space for inserting a date, time, and document date, document type or service type, fees, acts and/or other information.

In an embodiment, signature authentication records 122 are configured to include headings that describe each section of the information or record 122 and space for required information, signature, or other information. The signature record 122 may include information, identification, signatures, fingerprint, or other information record 120.

In an embodiment, the book 110 includes a plurality of information records 120 on the first side 114 of the book 110 and an associated plurality of private, personal, confidential, nonpublic, intellectual property, or secret information, identity, and/or signature authentication records 122 for a single record on the second side 116 of the book 110.

Figure 3:
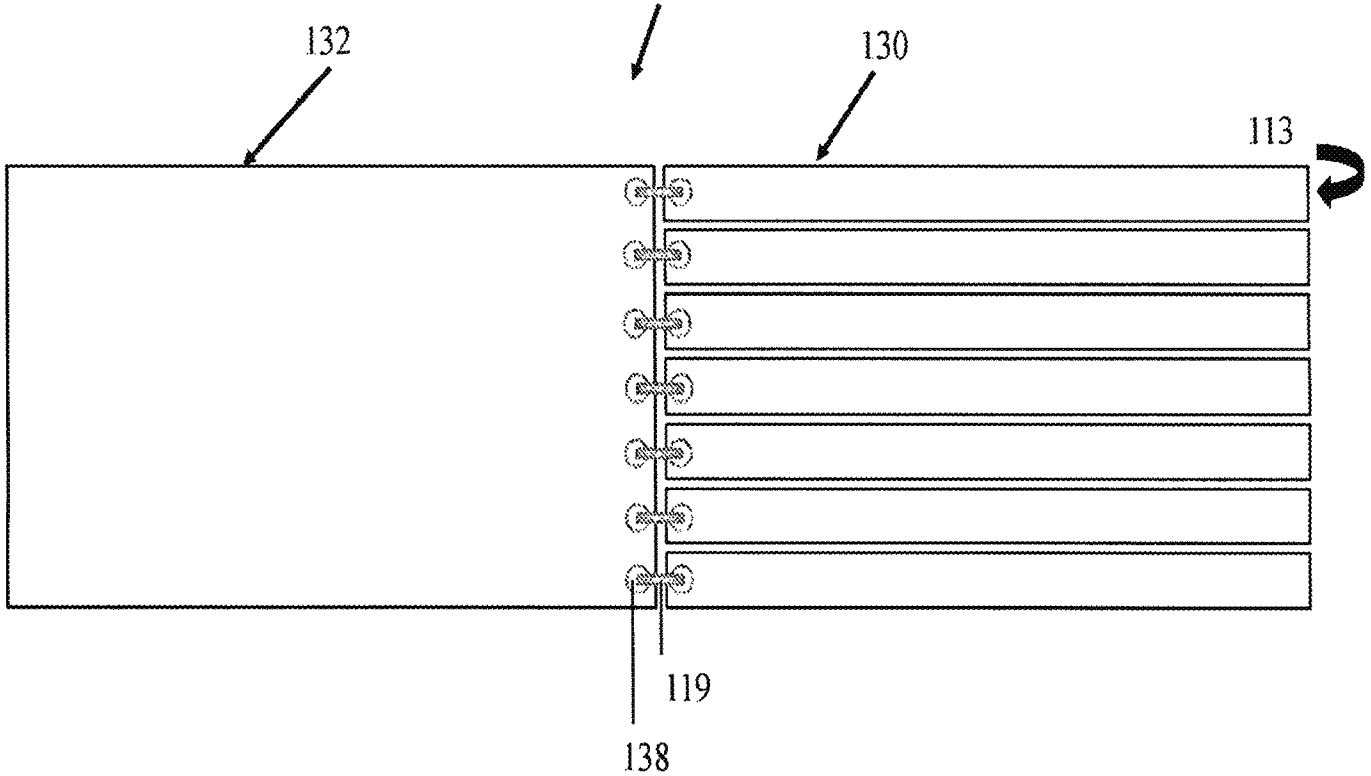
FIG. 3 shows an exemplary view of a covering device for use with systems and methods for covering, protecting, and concealing personal, private, confidential, and nonpublic information, intellectual property, or other information, according to one embodiment of the present invention.

In alternative embodiments, a tamper-evident security device comprises such as, for example, a sealed strip or security seal attached to the binding device 119 and/or through at least one combining hole 138 (FIG. 3). In another alternative embodiment comprises a tamper-evident security features such as, for example, bar codes, or radio frequency identification tags (not shown) inserted, attached to or part of the magnetic covering device 112, magnetic strips 113 (FIG. 3), or the covering device binding 118 (FIG. 1) with specific identifiable colors, numerical combinations, custom markings, warnings, labels, special code or identifier or other data embedded, printed, or attached in or to the covering device (112, 113) or the binding device 118 as an indication of association of the covering device 112, 113.

A covering device may include a binding 118 which device and/or binding may include one or more identifying information such as marks, letters, designs, numbers, sequential and/or random numbers, title, logo, and/or other identifiable components (also referred to as indicia) on the binding 118 (not shown) and which include an identifying label 101 (shown in FIGS. 1, 2A, and 4) may be configured in a plurality of shapes such as rectangular, square, circular, geometric, and made of a plurality of materials such as and including, but not limited to plastic, metal, paper, silk, wood, cardboard, leather, fabric, ribbon, felt, steel, tin, vinyl, precious metal, stone, cord, foil, carbon fiber, resin, graphene, synthetic elastomer, fiberboard, poly, acrylic, acrylic glass, plexiglass, bio-plastic, eco-plastic, polyesters, silicone, rubber, and cardstock, the label further including indicia such as a mark, letter, number, sequential number, bar code, author, title, logo, publisher, trademark, brand, decoration, price, picture, descriptor, category, lettering, clip art, image, design, graphic, Uniform Product Code (UPC), website, endorsement, International Standard Book Number (ISBN), Radio Frequency Identification (RFID), electronic identification (eID), Unique Identifier (UID), transponder, and microchip (collectively referred to as indicia) with information regarding the bound stack of which can also be used as a place marker. Alternatively, the identifying label 101 (FIG. 4) can be attached utilizing mechanisms including but not limited to wire, ribbon, rope, string, security seal, magnetic seal, ring, single loop fastener pair 125, and/or similar connecting mechanism, wherein the identifying spine label 101 can hang freely from the covering device connector 119, spiral binding (not shown) or editable spine binder (not shown) which can allow the identifying spine label to also be used as a place marker.

In a preferred embodiment, the covering device binding 119 is formed wherein it can rotate 360 degrees to fold back upon itself and lie flat when open. In an alternative embodiment the covering device can include one or more tamper-evident security features (not shown). In an alternative embodiment, a tamper-evident security seal such as an indicative seal, barrier seal, security seal, security sticker, plastic seal, metal seal, adjustable length seal, banking seal, fixed seal, bolt seal, screw seal, security ring, locking seal, padlock seal, Radio Frequency Identification (RFID) tag, electronic IDdentification (eID) tag, microchip tag, Unique Identifier (UID) tag, Personal Identifier (PID) tag, transponder, and digital identifier, (collectively referred to as security seal) (not shown) is inserted through one or more combining holes 138 (FIG. 3) of the connected covering device, attached to a binding device loop, and/or configured as part of the covering device.

FIG. 3 shows an exemplary view of a covering device 112 for use with systems and methods for providing security, binding, and labeling for a plurality of papers and their covers, and covering, protecting, and concealing personal, private, confidential, and nonpublic information, intellectual property, or other information, according to one embodiment of the present invention. The covering device 112 further comprises a first side 130 and a second side 132. In a preferred embodiment, the first side 130 and the second side 132 are connected with a combining device configured as a locking spine binder 119 to allow the covering device 112 to lay flat, and/or fold back upon itself, and configured to be non-removable and to remain closed. In an alternative embodiment, other covering device connectors include for example, punch and bind spiral binding, editable spine binder, etc. that allow the covering device 112 to be bound yet lay flat when open and fold back upon themselves. In an alternative embodiment covering devices bound with punch and bind bindings and spiral bindings are used in combination with a security feature such as a tamper-evident security seal inserted through at least one combining hole 138.

Preferably, the covering device 112 is double magnetized (magnetized on both sides of the material) such that the first side 130 is configured as double magnetized repositionable strips 113 and the second side 132 configured as a double magnetized sheet to attract the double magnetized repositionable strips 113 whereby the first side 130 remains in place and covers the second side 132 when the first side 130 is placed over the second side 132 yet the first side 130 is releasable on demand. Preferably, the double magnetized sheet and double magnetized strips are combined utilizing a spine binding device 119. In another preferred embodiment, the double magnetized sheet 132 and corresponding double magnetized strips are utilized to cover information and/or records containing private, personal, confidential, nonpublic, intellectual property, or secret information such as, for example, a book title, newspaper title and/or article, magazine title or cover, page, note, material, notebook, file, form, accounting ledger, business journal, blank book, log, scientific record, guest book, sign-in sheet, record sheet, sign, billboard, easel paper, poster, book, general office stationery, manifold book, day book, diary, portfolio, or other stationary, etc. In an embodiment, the double-magnetized covering device comprises a magnetic sheet material, without vinyl and/or paper coating and, a plurality of magnetic sheet strips constructed of magnetic material, without vinyl and/or paper coating. In yet another preferred embodiment, the magnetic covering device 112 comprises a substantially opaque covering device. In an embodiment, the double magnetized sheet is configured as a full standard letter size sheet in a portrait orientation with corresponding double magnetized strips. In an alternative embodiment, the double magnetized sheet is configured as a full standard letter size sheet in a landscape orientation with corresponding double magnetized strips. In another embodiment, the double magnetized sheet is configured as a standard legal-size sheet in a landscape orientation with corresponding double magnetized strips. In another embodiment, the double magnetized sheet is configured in a landscape or portrait orientation in any size with corresponding double magnetized strips. In a landscape orientation, the covering device 112 covers a book 110 in an open position and a sheet size of approximately 6"×22" with the first side 130 measuring 6"×11" and the second side 132 measuring 6"×11." In an embodiment, the first side 130 include eight magnetic or double magnetized repositionable strips 113 with each magnetic repositionable strip 113 measuring approximately $^{10}/_{16}$"×$10^{11}/_{16}$" with a distance between each magnetic repositionable strip 113 of approximately 2 mm. In the alternative embodiment where the covering device 112 comprises a single sheet adapted to fold in the center, an allowance for center bend is approximately 3 mm. In an embodiment, the magnetized covering device 112 has a portrait orientation for covering information. In a portrait orientation with the book 110 in an open position the covering device 112 comprises a sheet size of approximately 8"×11" with the first side 130 measuring 8"×11" and the second side 132 measuring 8"×11." In further embodiments, the magnetized covering device 112 may be single-side magnetized, double magnetized (magnetized on both sides), and may have any size and orientation (such as landscape) to cover information and/or cover information or embodiment on the book 110 or in an open or closed position according to the viewer or user's preference.

As shown in FIG. 3, in an embodiment second side 132 (also referred to as a left page) is configured as a solid sheet of double magnetized material and the first side 130 (also referred to as a right page) comprises corresponding double magnetized strips 113 and an unreleasable spine binder 119. Both the double magnetized sheet and the double magnetized strips can substantially turn through 360 degrees which can magnetically attach to a corresponding side independently and/or together. A user may place as many magnetic repositionable strips 113 as available or necessary over information or records 120 and identity or signature authentication records 122 to cover private, personal, confidential, nonpublic, intellectual property, or secret information during use of the book 110 or other information and/or records containing private, and/or nonpublic information such as, for example, a book title, newspaper title and/or article, magazine title or cover, page, note, material, notebook, file, form, accounting ledger, business journal, blank book, log, scientific record, guest book, sign-in sheet, record sheet, sign, billboard, easel paper, poster, book, general office stationery, manifold book, day book, diary, portfolio, other stationary, etc. The size of the magnetized covering device 112 can be customized to cover the first side 114 and second side 116 of the book 110 or other information or records mentioned above.

In an alternative embodiment, the double magnetized covering device 112 is configured to include one or more accessible handling tabs (not shown), which can be attached to, or a component of the double magnetized sheet or strip 132, 113, which can be placed, attached, or part of a double magnetized sheet or strip 132, 113, which can be in a horizontal, vertical, or other orientation.

In yet another alternative embodiment, the magnetized covering device 112 can be configured as a one-piece magnetic folder (also referred to as a sleeve) (not shown) covering device having at least two releasably connected substantially opaque sides and configured in a plurality of shapes, sizes, and materials, such that the magnetic folder covering device can be placed over any portion of or completely around or over one or more pages and magnetically adhere to its opposing side. The magnetic folder covering device may include a magnetic strip, component, or border, and can have one or more accessible handling tabs, which can be attached to or are a component of the magnetic folder and/or magnetic strip and placed at one or both ends of the magnetic folder, strip, or a top or bottom of the magnetic folder or strip.

Figure 4:
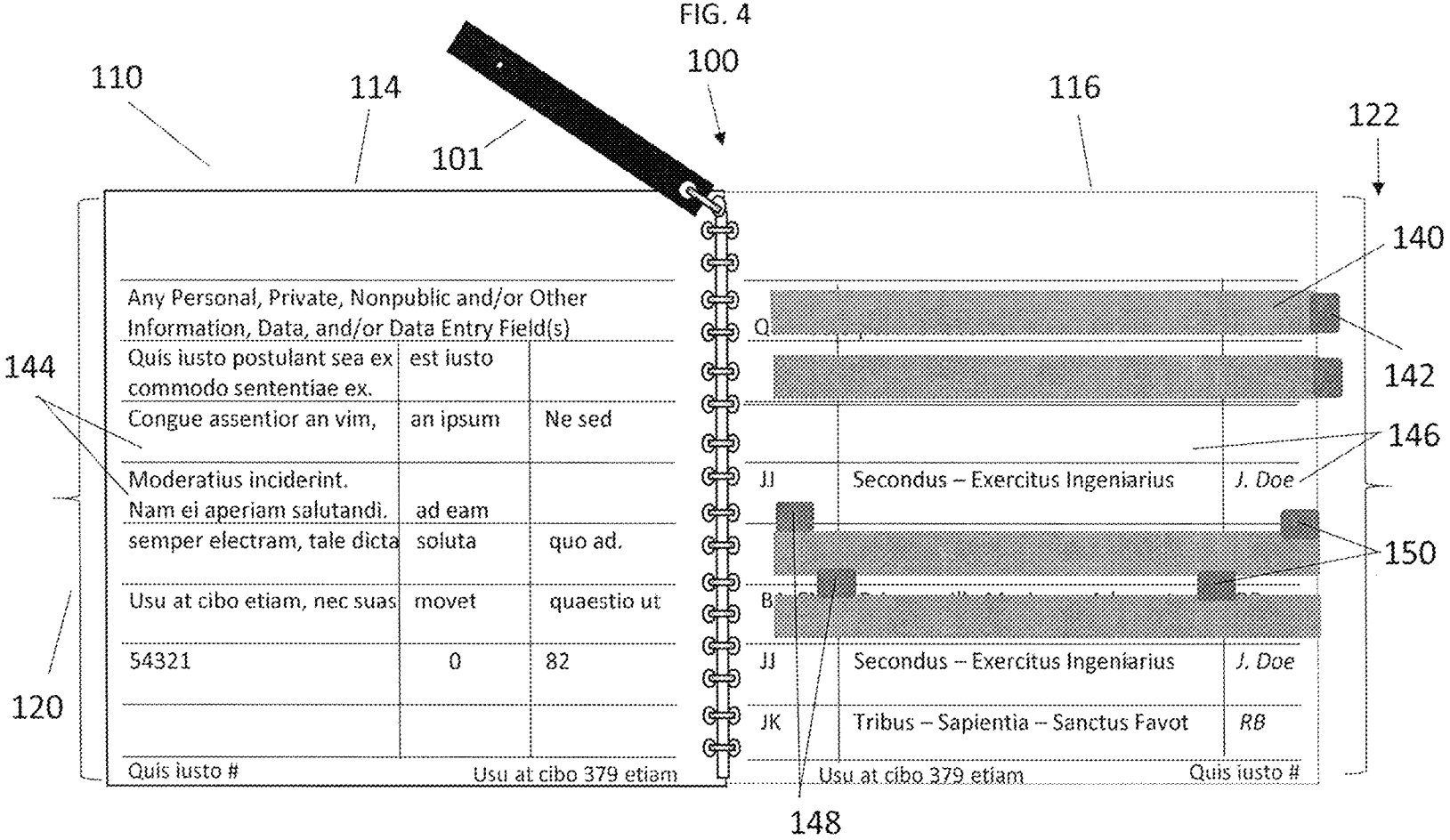
FIG. 4 shows an exemplary view of an alternative covering device for use with systems and methods for covering, protecting, and concealing personal, private, confidential, and nonpublic information, intellectual property, or other information, according to one embodiment of the present invention.

FIG. 4 shows an exemplary view of an alternative covering device configured as a repositionable substantially opaque adhesive strip 140 for use with systems and methods for providing security, binding, and labeling for a plurality of papers and their covers, and covering, protecting, and concealing the recording, viewing, or using of information, personal, private and nonpublic information, according to one embodiment of the present invention. As shown in this embodiment, the book 110 is in an open position. The repositionable substantially opaque adhesive strip 140 is configured to cover information 144 and/or shown on information records 120 and/or information 146 shown on identification or signature authentication records 122. In an embodiment, the repositionable substantially opaque adhesive strip 140 has repositionable adhesive on a bottom side (not visible) that allows for adhering to information or records 120 or identification or signature authentication records 122 yet is releasable on demand. In one embodiment, the repositionable substantially opaque adhesive strip 140 includes one or more tabs 142 (shown only at the top of the repositionable substantially opaque adhesive strip 140 for illustration purposes) for convenient placement and removal of the repositionable substantially opaque adhesive strip 140. A user may include as many repositionable substantially opaque adhesive strips 140 as necessary over the information, records 120, or identification or signature authentication records 122 to cover private and nonpublic information during use of the journal 110. In an alternative embodiment, the repositionable substantially opaque adhesive strips 140 include a first tab 148 and a second tab 150 for ease of removal and repositioning of the repositionable substantially opaque adhesive strips 140. In another embodiment, the repositionable substantially opaque adhesive strips 140 are utilized to cover other information or records containing private, or nonpublic information such as, for example, a book title, newspaper title and/or article, magazine title or cover, page, note, material, notebook, file, form, accounting ledger, business journal, blank book, log, scientific record, guest book, sign-in sheet, record sheet, sign, billboard, easel paper, poster, book, general office stationary, manifold book, day book, diary, portfolio, other stationary etc.

Another advantage of the present invention is a covering device having a binding can have an identification label that can expose the title or contents, can be concealed within, and be used as a place marker.

Another advantage of the present invention, for example, for a book, bound plurality of papers, or journal is that it reduces private, personal, confidential, nonpublic, intellectual property, or secret information exposure.

Another advantage of the present invention is the covering devices can be sized as preferred.

Still another advantage of the present invention is the inclusion of a tamper-evident security device and/or security seal such that the covering device, connected with a binding device, cannot be removed without being tamper-evident. The tamper-evident security device provides security enhancement and integrity to such covering device and can lay flat, or fold back.

Yet another advantage of the present invention is the covering devices cover information easily and affordably, generally remain in place until removed, are reusable, can be easy to use or carry, and can be custom sized and custom printed.

The present invention has been described above with reference to exemplary embodiments. Other embodiments will be apparent to those skilled in the art in light of this disclosure. The present invention may readily be implemented using configurations other than those described in the exemplary embodiments above. Therefore, these and other variations upon the exemplary embodiments are covered by the present invention.

I claim:

1. A covering device for releasably covering and concealing printed and/or hand-written text, lettering, graphics, drawings, and/or marks on at least one sheet, page, or page of a book comprising:

a plurality of strips wherein the strips have a first face and a second face and four edges and wherein the first face and/or the second face are magnetic or double magnetized; and a sheet wherein the sheet has a first face and a second face and four edges and wherein the first face and the second face is magnetic or double magnetized; and a connecting component configured to connect at least one magnetic or double magnetized strips to a magnetic or double magnetized sheet, and wherein the magnetic or double magnetized strips and the magnetic or double magnetized sheet are connected near or on one edge to form a repositionable system to cover and conceal printed and/or hand-written text, lettering, graphics, drawings, and/or marks on a sheet, a page, or page of a book.

2. The covering device of claim 1, wherein the magnetic or double magnetized strips and/or the magnetic or double magnetized sheet further comprises one or more non-adhesive handling tabs having a first face and a second face and four edges wherein a non-adhesive handling tab extends from at least one edge of the magnetic or double magnetized strip or sheet.

3. The covering device of claim 1, wherein the connecting component further comprises a binding or binding spine selected from the group of spiral, coil, wire, comb, clasp, and three-ring binding.

4. The covering device of claim 1, wherein one or more magnetic or double magnetized strips can be positioned on the first face or the second face of a sheet, page, or page of a book to cover and conceal printed and/or hand-written text, lettering, graphics, drawings, and/or marks, and wherein the first face or the second face of the magnetic or double magnetized sheet can be positioned on the reverse first face or the second face of the sheet, page, or page of a book and wherein one or more magnetic or double magnetized strips and the magnetic or double magnetized sheet can releasably magnetically adhere where positioned.

5. A covering device for covering and concealing printed and/or hand-written text, lettering, graphics, drawings, and/or marks on a sheet, a page, or page of a book comprising:

a first face, substantially opaque, having at least four sides;

and a second face having at least four sides; and a sleeve formed by joining at least one of the sides of the first face with at least one of the corresponding sides of the second face, while leaving the remaining sides of the two faces unjoined, wherein the user can slightly separate the folder sleeve at the unjoined edges and discretionally position the sleeve to encompass any portion of at least one sheet, page, or page of a book; and a folder sleeve wherein at least a portion or a far edge of the first face and/or the second face is magnetic or magnetized which allows the joined folder sleeve to slip over at least a portion of two faces of at least one sheet, page, or of a book which can allow the user to discretionarily cover and conceal printed and/or hand-written text, lettering, graphics, drawings, and/or marks on a sheet, a page, or page of a book and releasably and magnetically adhere to secure the folder sleeve where positioned.

6. A covering device for releasably covering and concealing printed and/or hand-written text, lettering, graphics, drawings, and/or marks, comprising:

a substantially opaque paper tape strip having a first face without repositionable adhesive and a second face having repositionable adhesive and four edges; and a substantially opaque paper tape strip having a first face without repositionable adhesive and a second face having repositionable adhesive and four edges, and having at least one edge having no adhesive that can serve as a handling tab wherein the tabbed, substantially opaque repositionable adhesive paper tape strip can be accessed by the handling tab to discretionarily position the strip, without touching the adhesive, on at least a portion of a sheet, page, or page of a book to cover and conceal printed and/or hand-written text, lettering, graphics, drawings, and/or marks, wherein the repositionable adhesive tape strip can releasably adhere where positioned and can be repositioned on the same sheet, or page, or page of a book, or on a separate sheet, a separate page, or separate page of a book, or on a separate page of a separate book.

* * * * *